US009016385B2

(12) United States Patent
Veit

(10) Patent No.: US 9,016,385 B2
(45) Date of Patent: Apr. 28, 2015

(54) SECURING CONNECTIONS IN ALTERNATE PATH WELL SCREENS

(71) Applicant: Halliburton Energy Services, Inc., Houston, TX (US)

(72) Inventor: Jan Veit, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/104,130

(22) Filed: Dec. 12, 2013

(65) Prior Publication Data

US 2014/0231097 A1 Aug. 21, 2014

(30) Foreign Application Priority Data

Feb. 20, 2013 (WO) ..... PCT/US2013/026817

(51) Int. Cl.

| | |
|---|---|
| ***E21B 19/16*** | (2006.01) |
| ***E21B 17/02*** | (2006.01) |
| ***E21B 43/04*** | (2006.01) |
| ***E21B 43/08*** | (2006.01) |

(52) U.S. Cl.

CPC ..... *E21B 17/02* (2013.01); *E21B 43/04* (2013.01); *E21B 43/08* (2013.01)

(58) Field of Classification Search

CPC ..... F16L 37/088; F16L 37/092; F16L 33/03; F16L 37/14; F16L 37/0842; E21B 43/08; E21B 43/04; E21B 17/02; E21B 17/18; E21B 43/106

USPC ..... 166/377, 378, 380, 242.6; 403/372; 285/321

See application file for complete search history.

(56) References Cited

U.S. PATENT DOCUMENTS

| | | | | | |
|---|---|---|---|---|---|
| 472,342 | A | * | 4/1892 | Draudt | 285/317 |
| 1,073,850 | A | * | 9/1913 | Greer | 285/109 |
| 2,440,452 | A | * | 4/1948 | Smith | 285/317 |
| 3,151,891 | A | * | 10/1964 | Sanders | 285/110 |
| 3,314,696 | A | * | 4/1967 | Ferguson et al. | 285/148.14 |
| 3,381,983 | A | * | 5/1968 | Hanes | 285/321 |
| 3,574,362 | A | * | 4/1971 | Gregg et al. | 285/321 |
| 3,625,551 | A | * | 12/1971 | Branton et al. | 285/305 |

(Continued)

FOREIGN PATENT DOCUMENTS

| | | | |
|---|---|---|---|
| JP | 2004-190758 | A | 7/2004 |
| JP | 2004190758 | A | 8/2004 |

OTHER PUBLICATIONS

Search Report and Written Opinion issued Oct. 25, 2013 for International Application No. PCT/US2013/026817, 9 pages.

(Continued)

*Primary Examiner* — Blake Michener
(74) *Attorney, Agent, or Firm* — Smith IP Services, P.C.

(57) ABSTRACT

A method of securing connections in well screens can include engaging a resilient ring with recesses formed in respective well screen connectors, the ring including projections extending from respective opposite ends of the ring, and disengaging the resilient ring from one of the recesses by relative displacement between the projections. A well screen connection can include well screen connectors, and a resilient ring received in annular recesses formed in the respective well screen connectors, projections extend from opposite ends of the ring and are received in an opening formed through a wall of one of the connectors, and the projections received in the opening prevent rotation of the ring relative to that connector.

13 Claims, 9 Drawing Sheets

(56) References Cited

U.S. PATENT DOCUMENTS

| | | | | | |
|---|---|---|---|---|---|
| 4,278,276 | A * | 7/1981 | Ekman | 285/49 |
| 4,685,708 | A * | 8/1987 | Conner et al. | 285/374 |
| 4,884,829 | A * | 12/1989 | Funk et al. | 285/24 |
| 5,341,880 | A * | 8/1994 | Thorstensen et al. | 166/278 |
| 5,490,694 | A * | 2/1996 | Shumway | 285/305 |
| 5,671,955 | A * | 9/1997 | Shumway | 285/305 |
| 5,868,200 | A * | 2/1999 | Bryant et al. | 166/51 |
| 5,876,071 | A * | 3/1999 | Aldridge | 285/321 |
| 5,979,946 | A * | 11/1999 | Petersen et al. | 285/305 |
| 6,062,611 | A | 5/2000 | Percebois et al. | |
| 6,065,779 | A | 5/2000 | Moner et al. | |
| 6,752,207 | B2 * | 6/2004 | Danos et al. | 166/278 |
| 7,393,019 | B2 * | 7/2008 | Taga et al. | 285/321 |
| 7,699,356 | B2 * | 4/2010 | Bucher et al. | 285/321 |
| 7,722,089 | B2 * | 5/2010 | Nauer | 285/321 |
| 7,954,860 | B2 * | 6/2011 | Suzuki | 285/374 |
| 2002/0189809 | A1 * | 12/2002 | Nguyen et al. | 166/278 |
| 2003/0000699 | A1 * | 1/2003 | Hailey, Jr. | 166/278 |
| 2008/0277929 | A1 * | 11/2008 | Bucher et al. | 285/317 |
| 2013/0032330 | A1 | 2/2013 | Heckel et al. | |

OTHER PUBLICATIONS

International Search Report and Written Opinion issued Oct. 25, 2013 for PCT Patent Application No. PCT/US2013/026817, 9 pages.

www.smalley.com, "HH/HHU Series: Hoopster® Rings", product specification brochure, received on Feb. 3, 2013, 1 page.

Smalley® Steel Ring Company, "Hoopster® Rings", product description web page, dated Feb. 3, 2013, retrieved from http://www.smalley.com/retaining_rings/hoopster_rings.asp, 2 pages.

* cited by examiner

SECURING CONNECTIONS IN ALTERNATE PATH WELL SCREENS

CROSS-REFERENCE TO RELATED APPLICATION

This application claims the benefit under 35 USC §119 of the filing date of International Application Serial No. PCT/US13/26817, filed 20 Feb. 2013. The entire disclosure of this prior application is incorporated herein by this reference.

BACKGROUND

This disclosure relates generally to equipment utilized and operations performed in conjunction with a subterranean well and, in one example described below, more particularly provides for securing connections in alternate path well screens.

Shunt tubes are sometimes used to provide alternate paths for slurry flow in an annulus between a tubular string (such as, a completion string) and a wellbore. In this manner, the slurry can bypass blockages or restrictions (such as, sand bridging) in the annulus.

Well screen assemblies can be constructed with shunt tubes therein, but connections should be made between shunt tubes of different well screen assemblies. Other connections also should be made in such well screen assemblies. Therefore, it will be appreciated that improvements are continually needed in the arts of constructing and utilizing screens with alternate paths for use in wells.

DETAILED DESCRIPTION

Figure 1:
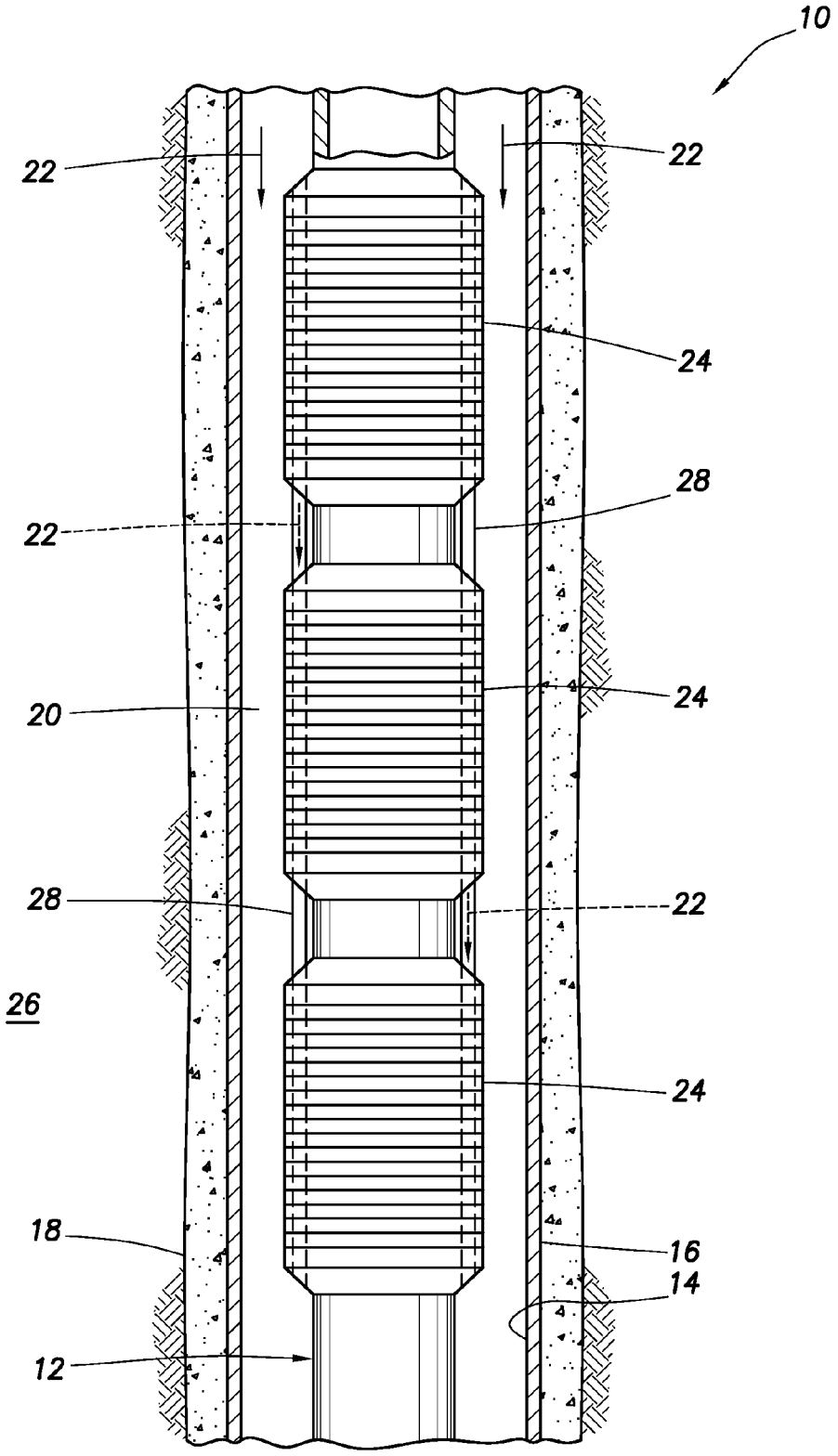
FIG. 1 is a representative partially cross-sectional view of a well system and associated method which can embody principles of this disclosure.

Representatively illustrated in FIG. 1 is a system 10 for use with a well, and an associated method, which system and method can embody principles of this disclosure. However, it should be clearly understood that the system 10 and method are merely one example of an application of the principles of this disclosure in practice, and a wide variety of other examples are possible. Therefore, the scope of this disclosure is not limited at all to the details of the system 10 and method described herein and/or depicted in the drawings.

In the FIG. 1 example, a tubular string 12 is positioned in a wellbore 14 lined with casing 16 and cement 18. An annulus 20 is formed radially between the tubular string 12 and the wellbore 14.

In other examples, the wellbore 14 could be uncased or open hole, the wellbore could be generally horizontal or inclined, etc. The annulus 20 is not necessarily concentric, since the tubular string 12 could be to one side or another of the wellbore 14, etc.

It is desired in the FIG. 1 example to fill the annulus 20 with "gravel" about well screens 24 connected in the tubular string 12. For this purpose, a slurry 22 is flowed into the annulus 20, for example, from a surface location.

The slurry 22 in this example is erosive and may comprise a particulate portion (e.g., sand, gravel, proppant, etc.) and a liquid portion. The liquid portion may flow inwardly through the well screens 24 into the tubular string 12, and/or out into a formation 26 surrounding the wellbore 14 (e.g., via perforations, not shown, formed through the casing 16 and cement 18), leaving the particulate portion in the annulus 20 about the well screens 24.

If a fracturing operation is performed, the particulate portion (e.g., proppant, etc.) can flow into fractures formed in the formation 26. Such gravel packing, fracturing, etc., operations are well known to those skilled in the art, and so are not described further herein. The scope of this disclosure is not limited to any particular gravel packing or fracturing operation being performed in the wellbore 14.

Part of the slurry 22 is also permitted to flow through shunt tube assemblies 28 extending through the screens 24. The shunt tube assemblies 28 provide multiple alternate paths for the slurry 22 flow, in order to prevent voids in the particulate portion which accumulates about the tubular string 12.

In the FIG. 1 example, each of the shunt tube assemblies 28 provides fluid communication between sections of the annulus 20 on opposite ends of a corresponding screen 24. In addition, as described more fully below, each of the shunt tube assemblies 28 includes nozzles (not visible in FIG. 1) which direct flow of the slurry 22 outward into the annulus 20 along the screen 24, so that a more even distribution of the slurry in the annulus is achieved.

Figure 2:
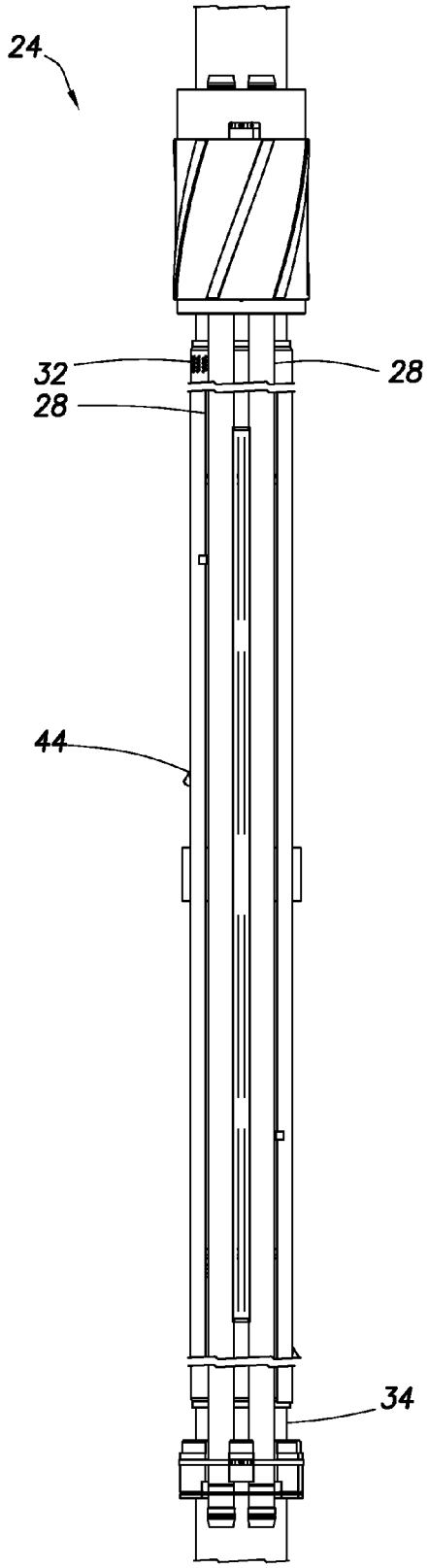
FIGS. 2 & 3 are elevational and partially cross-sectional views of a well screen which may be used in the system and method.
Figure 3:
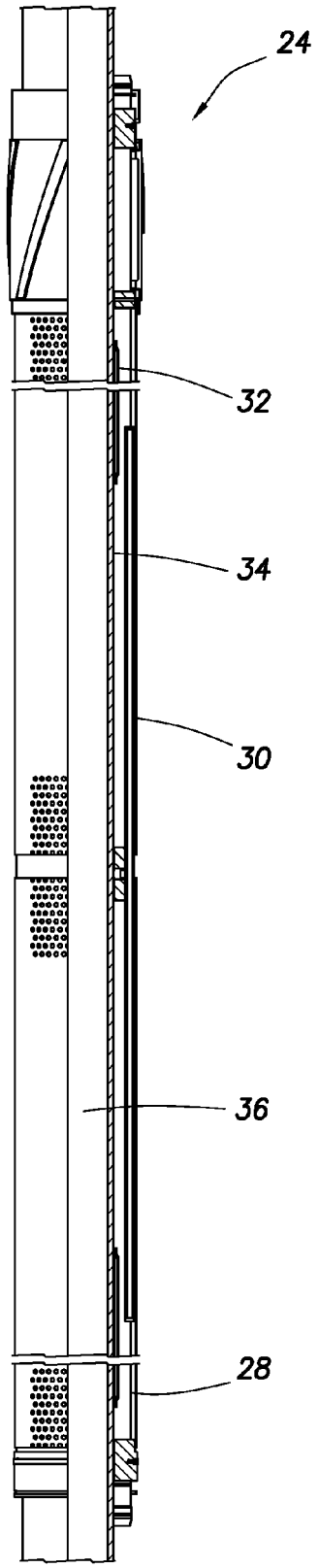

Referring additionally now to FIGS. 2 & 3, an example of a well screen 24 is representatively illustrated in elevational and partially cross-sectional views. The screen 24 may be used in the system 10 and method of FIG. 1, or the screen may be used in other systems and methods.

In FIG. 2, a perforated outer shroud 30 of the screen 24 is removed, so that two shunt tube assemblies 28 are visible. The outer shroud 30 is shown in FIG. 3.

Note that the shunt tube assemblies 28 are positioned in a non-concentric annular space between the outer shroud 30 and a filter 32 which encircles a perforated base pipe 34 of the screen 24. The filter 32 could comprise a mesh, wire wrap, sintered, woven or other type of filter material.

A flow passage 36 which extends longitudinally through the base pipe 34 also extends longitudinally in the tubular string 12 when the screen 24 is used in the system 10 and method of FIG. 1. Thus, the liquid portion of the slurry 22 can flow inwardly through the outer shroud 30, the filter 32 and the base pipe 34, and into the flow passage 36. In other examples, if fracturing of the formation 26 is desired, flow of the liquid portion into the passage 36 may be restricted or prevented, until after the fracturing operation.

Figure 4:
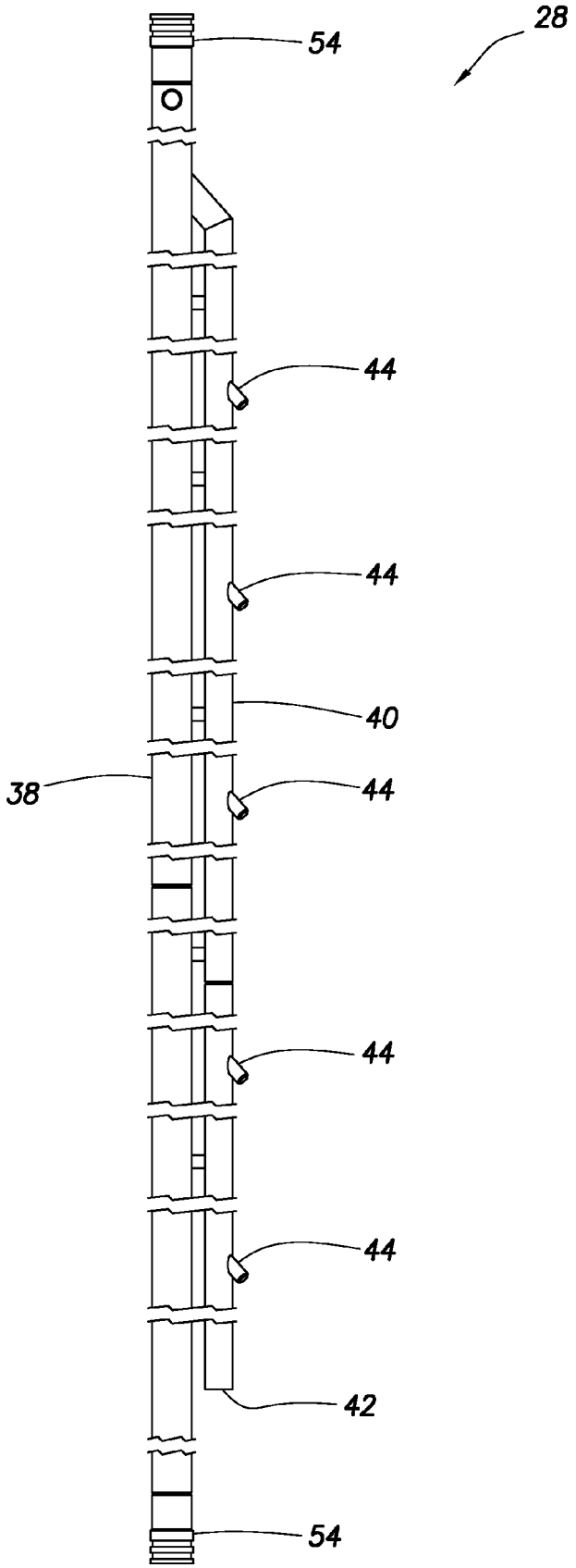
FIG. 4 is an elevational view of a shunt tube assembly which may be used in the well screen.

Referring additionally now to FIG. 4, an example of one of the shunt tube assemblies 28 is representatively illustrated, apart from the screen 24. In this view, it may be seen that the assembly 28 includes generally parallel tubes 38, 40. These tubes 38, 40 are of the type known to those skilled in the art as transport (or jumper) and packing tubes, respectively.

The slurry 22 can flow completely through the tube 38 (e.g., from one screen 24 to another), but a lower end 42 of the tube 40 may be closed off, so that the slurry 22 is directed outward from the tube 40 via nozzles 44. In some examples, the slurry 22 can flow outwardly through the lower end 42 of the tube 40, and through the nozzles 44.

At this point it should be recognized that the shunt tube assemblies 28 described herein are merely one example of a wide variety of different ways in which a shunt flow path can be provided for a slurry in a well. It is not necessary for the shunt tube assemblies 28 to be constructed as depicted in the drawings, the shunt tube assemblies are not necessarily positioned between the outer shroud 30 and the filter 32 or base pipe 34, the nozzles 44 are not necessarily connected to one of two parallel tubes, the shunt flow path does not necessarily extend through tubes, etc. Thus, it will be appreciated that the scope of this disclosure is not limited to the details of the screen 24 or shunt tube assemblies 28 as described herein or depicted in the drawings.

Figure 5:
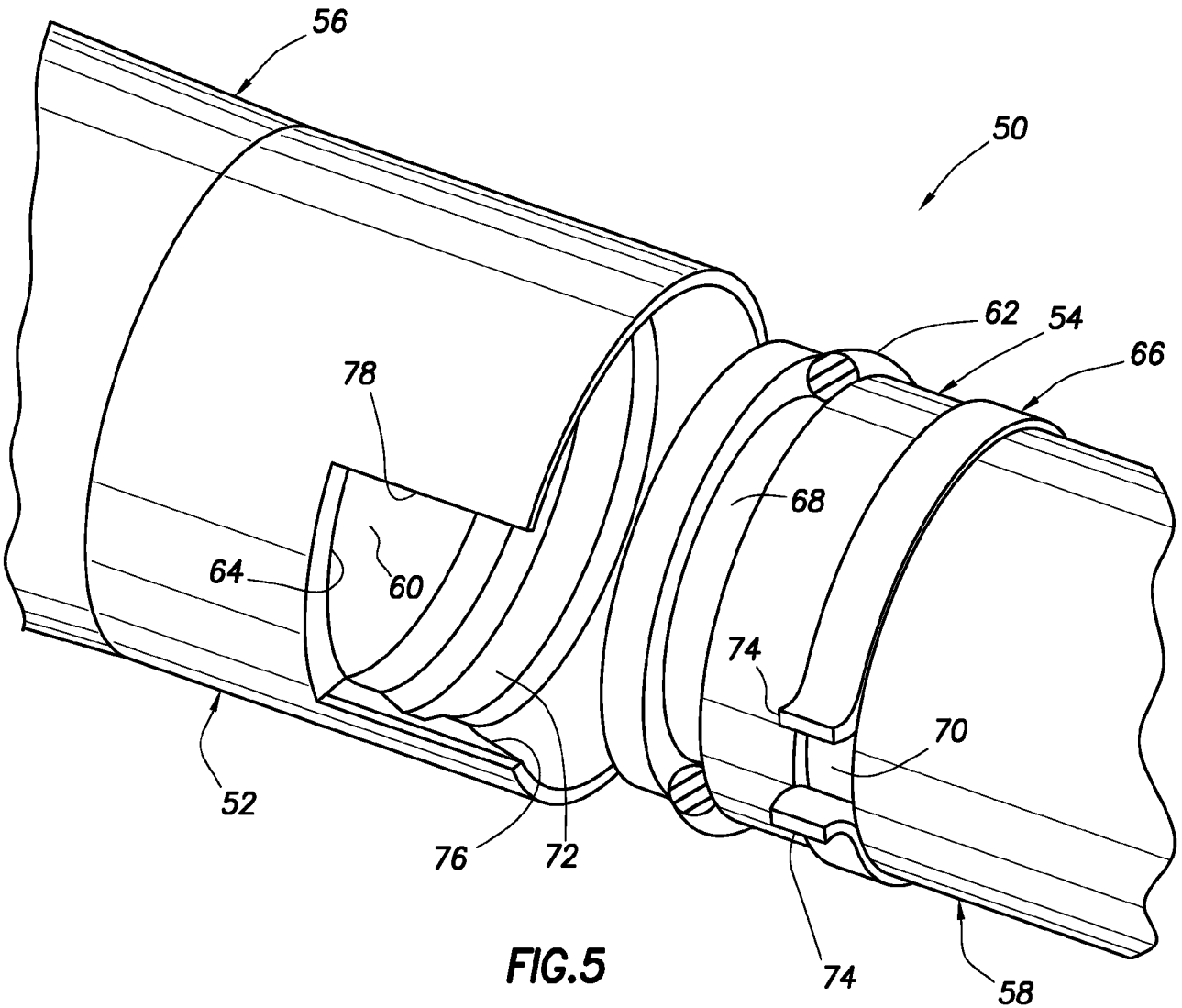
FIG. 5 is an enlarged scale representative perspective view of a connection which may be used with shunt tube assemblies.
Figure 6:
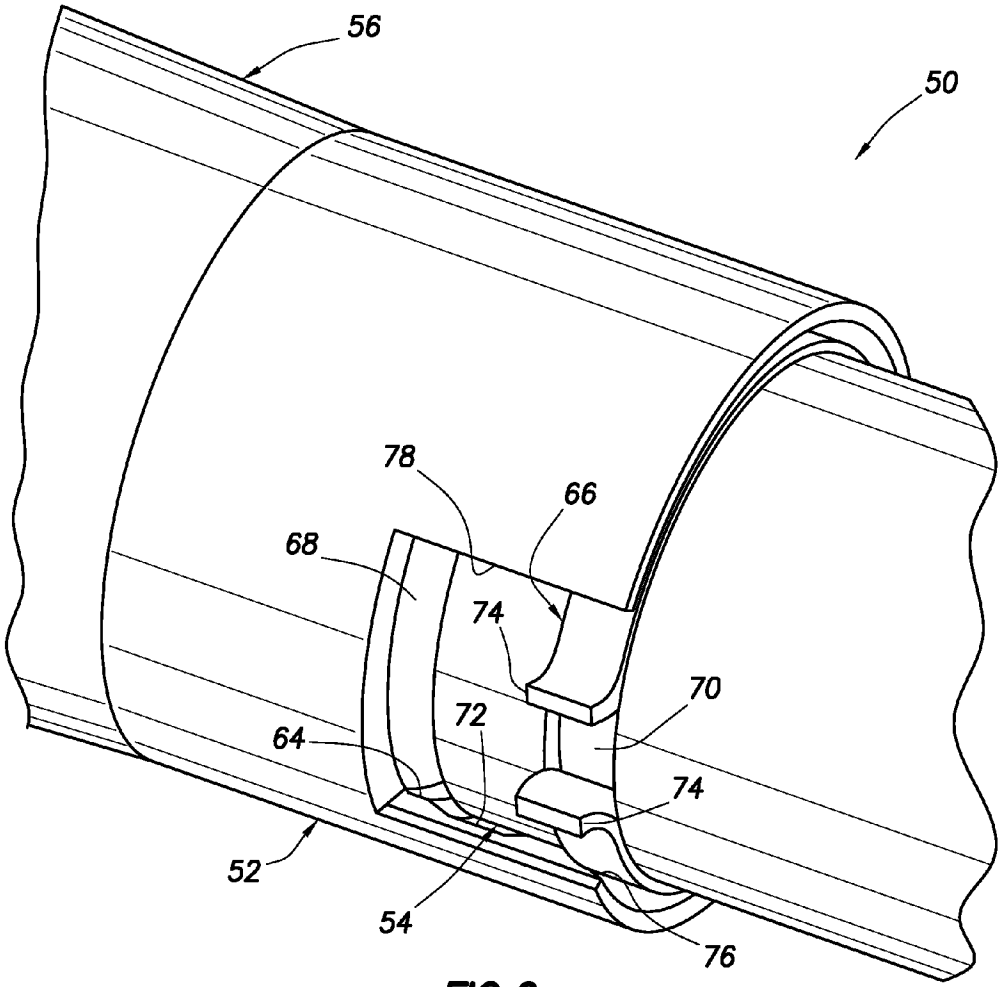
FIG. 6 is a representative perspective view of the connection, in which connectors are being coupled to each other.
Figure 7:
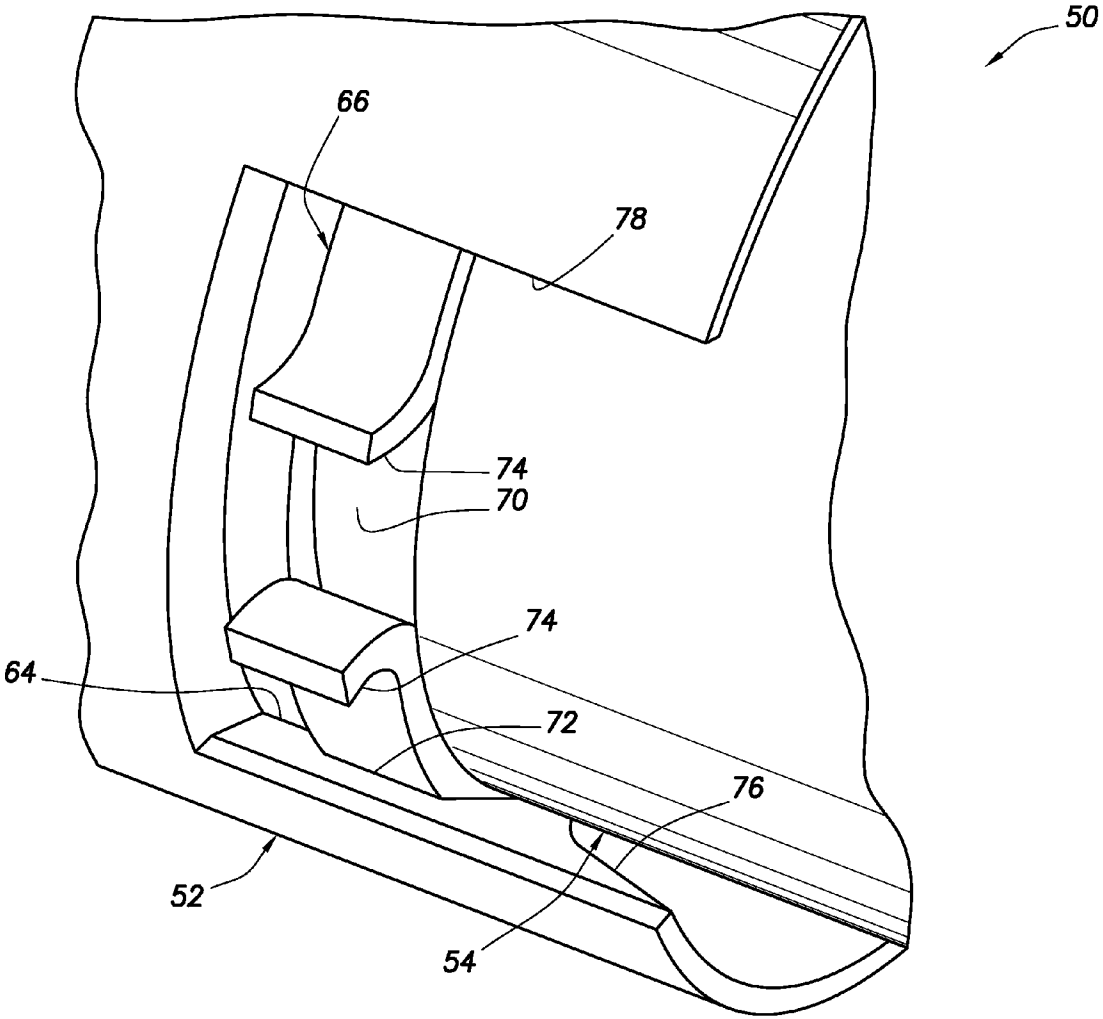
FIG. 7 is a representative perspective view of the connection, in which the connectors are secured to each other.

Referring additionally now to FIGS. 5-7, a well screen connection 50 is representatively illustrated, apart from the remainder of the well screen 24. In this example, the connection 50 is used to couple two connectors 52, 54 and thereby secure a sealed slurry flow path 60 between well screen components 56, 58.

The connectors 54, 56 may be formed on the respective components 56, 58, or they may be constructed and then separately attached to the components. The scope of this disclosure is not limited to any particular manner of providing the connectors 52, 54 or attaching them to the components 56, 58.

The connection 50 depicted in FIG. 5 can be used to couple together shunt tube assemblies 28 of multiple well screens 24. For example, in FIG. 4, the connectors 54 are depicted at each opposite end of the shunt tube assembly 28, in which case the tube 38 can comprise the component 58 illustrated in FIG. 5. The other component 56 may, for example, comprise a coupling having the connectors 52 at opposite ends thereof.

However, it should be clearly understood that the scope of this disclosure is not limited to use of the connection 50 for coupling shunt tube assemblies 28. In other examples, the connection 50 may not be used to secure a sealed slurry flow path, the connectors 54 may not be used at each end of a shunt tube assembly, the connectors 52 may not be used at opposite ends of a coupling, etc. In some examples described below, the connection 50 can be used to secure a centralizer or a shroud. Thus, the scope of this disclosure is not limited to any particular use of the connection 50.

In the FIG. 5 example, a seal 62 is received in an annular recess 68 formed on the connector 54. When the connectors 52, 54 are coupled together, the seal 62 will be sealingly engaged with a seal bore 64 formed in the connector 52 (see FIG. 7).

A resilient, generally C-shaped ring 66 is received in another annular recess 70 formed on the connector 54. When the connectors 52, 54 are coupled together, the ring 66 will be received in another annular recess 72 formed in the connector 52 (see FIG. 7).

The ring 66 in this example has projections 74 extending radially outward from opposite ends of the ring. By displacing the projections 74 toward each other, the ring 66 can be deformed radially inward. This radially inward deformation of the ring 66 can be used to disconnect the connectors 52, 54 by disengaging the ring from the recess 72 prior to separating the connectors.

In other examples, the ring 66 could be initially received in the recess 72 in the connector 52. In that case, the projections 74 could be displaced away from each other to thereby deform the ring 66 radially outward. This radially outward deformation of the ring 66 could be used to disconnect the connectors 52, 54 by disengaging the ring from the recess 70 prior to separating the connectors. Thus, the scope of this disclosure is not limited to any particular positions of the ring 66, projections 74 or recesses 70, 72, or to any particular manner of connecting or disconnecting the connectors 52, 54.

The projections 74 are formed on each end of the ring 66, and are bent outward. In other examples, the projections 74 could be separately constructed and then attached to the ring 66, the projections could extend inward instead of outward, etc. Thus, the scope of this disclosure is not limited to any particular manner of forming, constructing or orienting the projections 74.

The ring 66 in the FIGS. 5-7 examples has a generally flat rectangular cross-section, with a radial width of the ring being less than a longitudinal length of the ring. However, the scope of this disclosure is not limited to any particular configuration of the ring 66.

As depicted in FIG. 6, the connectors 52, 54 are partially coupled to each other. An inclined surface 76 deforms the ring 66 radially inward as the connector 54 is inserted into the connector 52.

In other examples, the ring 66 could be radially inwardly deformed prior to inserting the connector 54 into the connector 52. For example, the projections 74 could be squeezed together and maintained in such a position by use of a clamp, a wire, a fastener, etc. Thus, it is not necessary for engagement between the connectors 52, 54 to cause radial deformation of the ring 66.

Although the ring 66 is deformed radially inward in the FIG. 6 example, in other examples the ring could be deformed radially outward to enable coupling of the connectors 52, 54. For example, if the ring 66 were to be carried in the recess 72 in the connector 52, then insertion of the connector 54 into the connector 52 could cause radially outward deformation of the ring (e.g., due to engagement of the ring with an inclined surface on the connector 54). Thus, the scope of this disclosure is not limited to any particular type of deformation of the ring 66.

In FIG. 7, the connection 50 is depicted with the connectors 52, 54 secured to each other. The ring 66 is received in both of the recesses 70, 72 and prevents disconnection of the connectors 52, 54.

Note that the projections 74 are received in an opening 78 formed through a wall of the connector 52. The projections 74 extend radially outward into the opening 78.

Engagement of the projections 74 in the opening 78 prevents significant rotation of the ring 66 relative to the connector 52. In this manner, the projections 74 remain received in the opening 78 after the connectors 52, 54 are coupled to each other.

In the FIG. 7 example, the opening 78 is generally rectangular in shape and extends to an end of the connector 52. In other examples, the opening 78 could have other shapes, and could be otherwise positioned in the wall of the connector 52.

The opening 78 provides access to the projections 74, in case it is desired to disconnect the connectors 52, 54. The opening 78 also retains the ring 66 in an appropriate rotational position relative to the connector 52, so that the projections 74 are accessible for disassembly.

Figure 8:
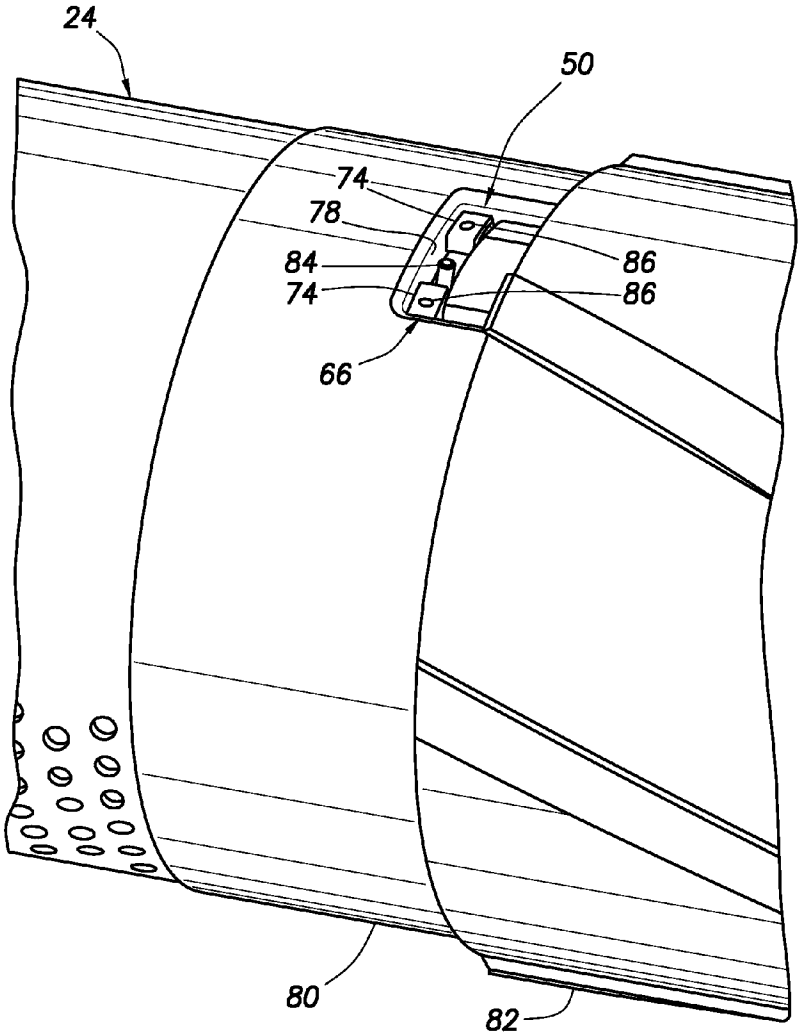
FIG. 8 is a representative perspective view of another connection in a well screen assembly, in which a centralizer is secured.

Referring additionally now to FIG. 8, another example of the connection 50 is representatively illustrated. In this example, the connection 50 is used to secure a retaining sleeve 80 relative to the base pipe 34. The retaining sleeve 80 retains a centralizer 82 in position relative to the well screen 24.

A pin 84 is used in this example to prevent rotation of the ring 66. Holes 86 are provided in the projections 74 for ease of assembly and disassembly.

Figure 9:
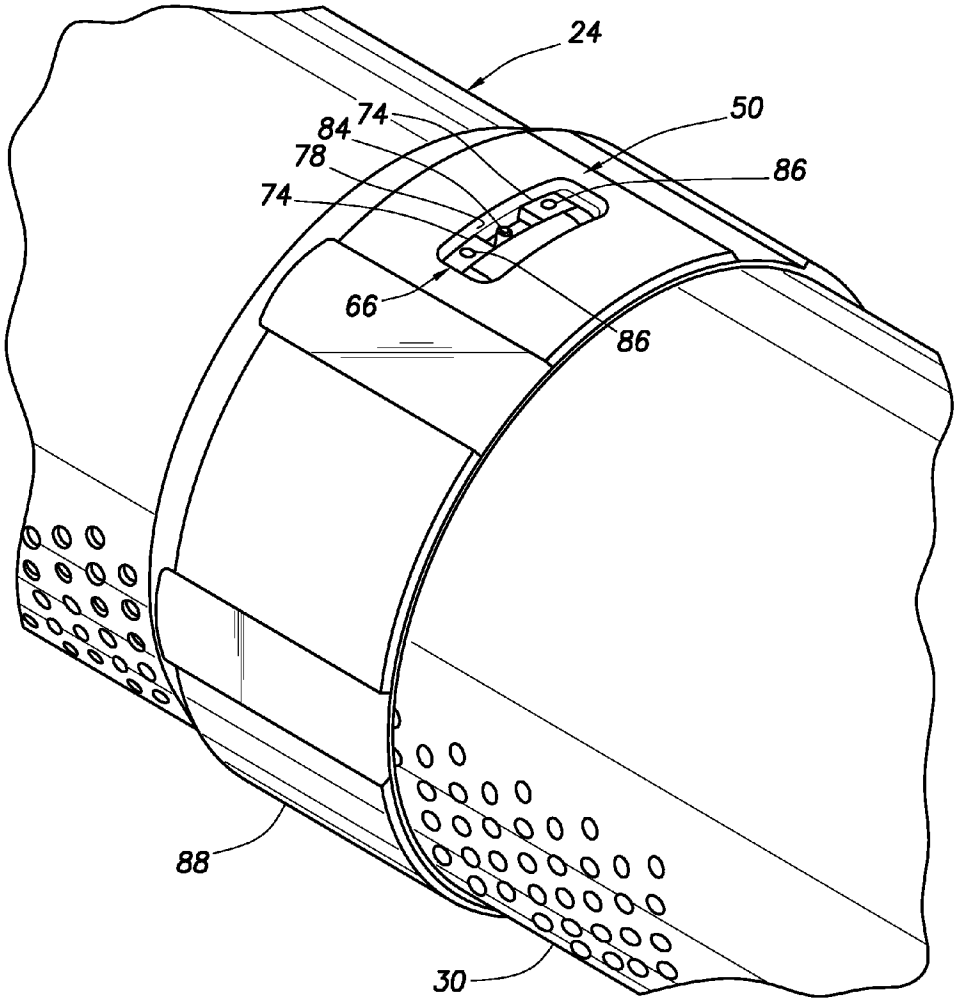
FIG. 9 is a representative perspective view of another connection in a well screen assembly, in which a shroud is secured.

Referring additionally now to FIG. 9, another example of the connection 50 is representatively illustrated. In this example, the connection 50 is used to secure a shroud retaining sleeve 88 relative to the base pipe 34. The retaining sleeve 88 retains the shroud 30 in position in the well screen 24.

Figure 10:
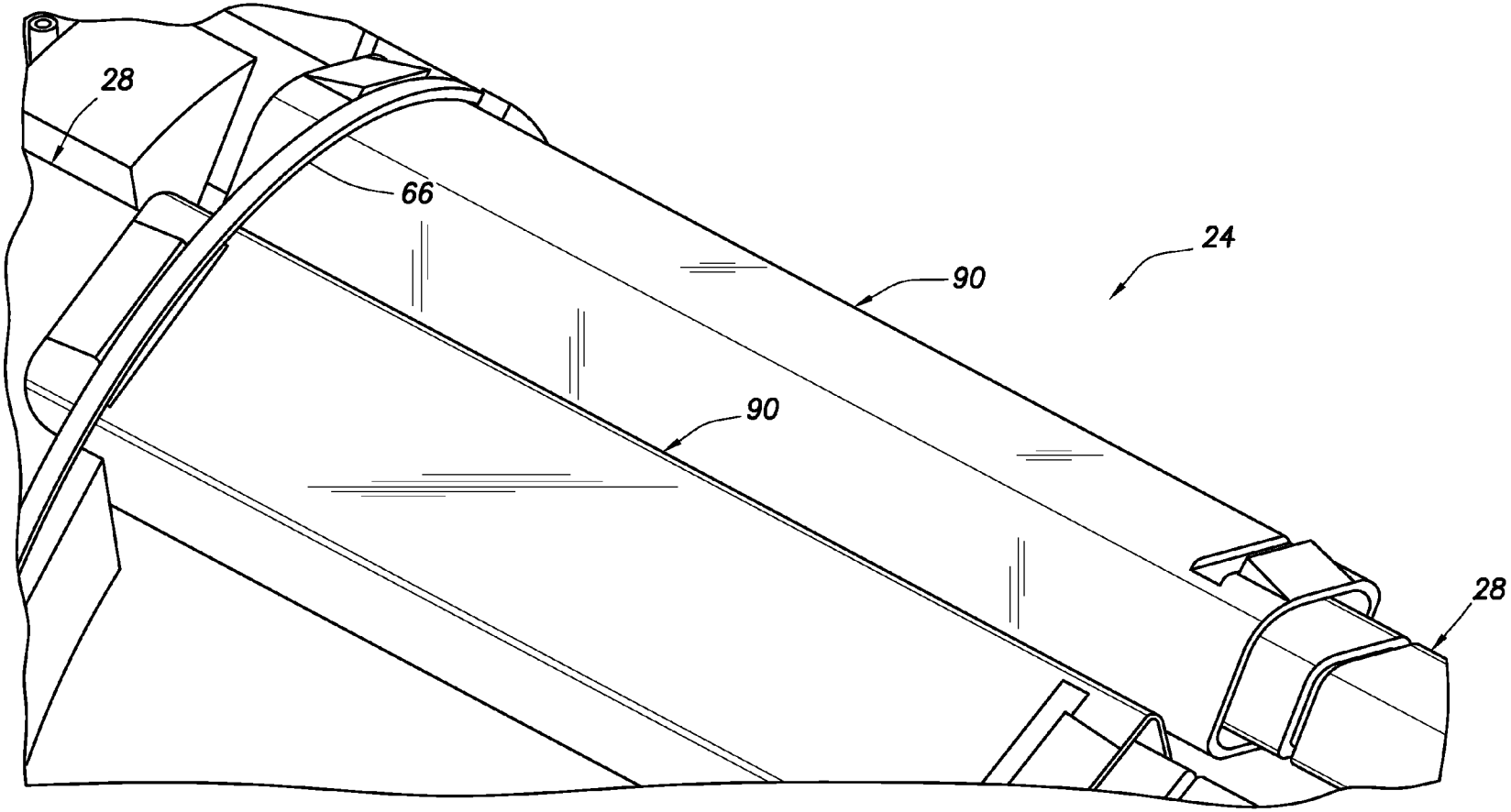
FIG. 10 is a representative perspective view of yet another connection in a well screen assembly, in which a shunt tube coupler is secured.

Referring additionally now to FIG. 10, another example of the connection 50 is representatively illustrated. In this example, couplings 90 are used to couple together shunt tube assemblies 28. The couplings 90 may be used to connect shunt tube assemblies 28 in a well screen 24, or between multiple well screens.

The connection 50 described above may be used to connect the shunt tube assemblies 28 to the couplings 90. A ring 66 may be used to secure the couplings 90 in the well screen 24, for example, by encircling the couplings and engaging a recess 72 formed in an outer sleeve (such as, the retaining sleeve 88). Thus, the connection 50 may be used for a variety of different purposes with one or more well screens 24, and the scope of this disclosure is not limited to any particular manner of using the connection with a well screen.

A method of securing connections 50 in well screens 24 is provided to the art by the above disclosure. In one example, the method can comprise engaging a resilient ring 66 with first and second recesses 72, 70 formed in respective first and second well screen connectors 52, 54, the ring 66 including projections 74 extending from respective opposite ends of the ring 66; and disengaging the resilient ring 66 from one of the first and second recesses 72, 70 by relative displacement between the projections 74.

An opening 78 may be formed in the first connector 52, the projections 74 extending into the opening 78.

The disengaging step can include displacing at least one of the projections 74 in the opening 78. One or both of the projections 74 may be displaced toward or away from the other to disengage the ring 66 from one of the recesses 70, 72.

The engagement of the projections 74 with the opening 78 may prevent rotation of the ring 66 relative to the first connector 52.

The engaging step can include radially deforming the ring 66.

The first and second connectors 52, 54 may couple together shunt tube assemblies 28 of the well screens 24.

The engaging step may include securing a centralizer 82 relative to the well screens 24.

The engaging step may include securing a well screen shroud 30.

Also described above is a well screen connection 50. In one example, the connection 50 can include first and second well screen connectors 52, 54, and a resilient ring 66 received in first and second annular recesses 72, 70 formed in the respective first and second well screen connectors 52, 54. Projections 74 extend from opposite ends of the ring 66 and are received in an opening 78 formed through a wall of the first connector 52. The projections 74 received in the opening 78 prevent rotation of the ring 66 relative to the first connector 52.

Relative displacement between the projections 74 can disengage the ring 66 from one of the first and second recesses 72, 70. The relative displacement may comprise displacement of one or both of the projections 74 toward or away from each other.

An inclined surface 76 formed on one of the first and second connectors 52, 54 may radially deform the ring 66.

The first and second connectors 52, 54 may couple together well screen shunt tube assemblies 28, secure a centralizer 82 relative to a well screen 24, and/or secure a well screen shroud 30.

Although various examples have been described above, with each example having certain features, it should be understood that it is not necessary for a particular feature of one example to be used exclusively with that example. Instead, any of the features described above and/or depicted in the drawings can be combined with any of the examples, in addition to or in substitution for any of the other features of those examples. One example's features are not mutually exclusive to another example's features. Instead, the scope of this disclosure encompasses any combination of any of the features.

Although each example described above includes a certain combination of features, it should be understood that it is not necessary for all features of an example to be used. Instead, any of the features described above can be used, without any other particular feature or features also being used.

It should be understood that the various embodiments described herein may be utilized in various orientations, such as inclined, inverted, horizontal, vertical, etc., and in various configurations, without departing from the principles of this disclosure. The embodiments are described merely as examples of useful applications of the principles of the disclosure, which is not limited to any specific details of these embodiments.

In the above description of the representative examples, directional terms (such as "above," "below," "upper," "lower," etc.) are used for convenience in referring to the accompanying drawings. However, it should be clearly understood that the scope of this disclosure is not limited to any particular directions described herein.

The terms "including," "includes," "comprising," "comprises," and similar terms are used in a non-limiting sense in this specification. For example, if a system, method, apparatus, device, etc., is described as "including" a certain feature or element, the system, method, apparatus, device, etc., can include that feature or element, and can also include other features or elements. Similarly, the term "comprises" is considered to mean "comprises, but is not limited to."

Of course, a person skilled in the art would, upon a careful consideration of the above description of representative embodiments of the disclosure, readily appreciate that many modifications, additions, substitutions, deletions, and other changes may be made to the specific embodiments, and such changes are contemplated by the principles of this disclosure. For example, structures disclosed as being separately formed can, in other examples, be integrally formed and vice versa. Accordingly, the foregoing detailed description is to be clearly understood as being given by way of illustration and example only, the spirit and scope of the invention being limited solely by the appended claims and their equivalents.

What is claimed is:

1. A method of securing connections in well screens, the method comprising:

providing a first well screen connector including a resilient split ring positioned within a first annular recess formed in the first connector, the ring having a rectangular cross-section and including projections extending from respective opposite ends of the ring;

providing a second well screen connector including a second annular recess formed in the second connector; and inserting the second connector into the first connector, the second connector including an inclined surface which radially expands the ring during the inserting, wherein a portion of the rectangular cross-section contracts into the second annular recess upon completion of the inserting, thereby securing the second connector to the first connector.

2. The method of claim 1, wherein an opening is formed in the first connector, the projections extending into the opening.

3. The method of claim 2, wherein engagement of the projections within the opening prevents rotation of the ring relative to the first connector.

4. The method of claim 1, wherein the second connector is released from the first connector in response to displacement of the projections away from each other.

5. The method of claim 1, wherein the first and second connectors couple together first and second shunt tube assemblies.

6. The method of claim 1, wherein the first and second connectors secure a centralizer to a well screen.

7. The method of claim 1, wherein the first and second connectors secure a shroud to a well screen.

8. A well screen connection, comprising:

first and second well screen connectors including first and second annular recesses formed in the respective first and second well screen connectors; and a resilient split ring received in the first annular recess, the ring having a rectangular cross-section, wherein projections extend from opposite ends of the ring and are received in an opening formed through a wall of the first connector, wherein the second connector includes an inclined surface which radially expands the ring during insertion of the second connector into the first connector, and wherein a portion of the rectangular cross-section contracts into the second annular recess upon completion of the insertion, thereby forming the well screen connection.

9. The well screen connection of claim 8, wherein the projections received in the opening prevent rotation of the ring relative to the first connector.

10. The well screen connection of claim 8, wherein the first and second connectors couple together first and second shunt tube assemblies.

11. The well screen connection of claim 8, wherein the first and second connectors secure a centralizer to a well screen.

12. The well screen connection of claim 8, wherein the first and second connectors secure a shroud to a well screen.

13. The well screen connection of claim 8, wherein the second connector is released from the first connector in response to displacement of the projections away from each other.

* * * * *